US009963277B2

(12) United States Patent
Li et al.

(10) Patent No.: US 9,963,277 B2
(45) Date of Patent: May 8, 2018

(54) CUP COVER WITH QUICK LOCKING FUNCTION AND CUP

(71) Applicant: Shenzhen Mecare Network Technology Co., Ltd., Shenzhen (CN)

(72) Inventors: XiaoLiang Li, Shenzhen (CN); YaFeng Bao, Shenzhen (CN)

(73) Assignee: SHENZHEN MECARE NETWORK TECHNOLOGY CO., LTD., Shenzhen (CN)

( * ) Notice: Subject to any disclaimer, the term of this patent is extended or adjusted under 35 U.S.C. 154(b) by 44 days.

(21) Appl. No.: 15/188,566

(22) Filed: Jun. 21, 2016

(65) Prior Publication Data

US 2017/0313479 A1 Nov. 2, 2017

(30) Foreign Application Priority Data

Apr. 27, 2016 (CN) ..... 2016 2 0368238 U

(51) Int. Cl.

*B65D 43/22* (2006.01)
*B65D 47/08* (2006.01)
*A47G 19/22* (2006.01)

(52) U.S. Cl.

CPC ..... *B65D 47/0885* (2013.01); *A47G 19/2272* (2013.01); *B65D 43/22* (2013.01); *B65D 2251/1016* (2013.01); *B65D 2251/1025* (2013.01); *B65D 2251/1058* (2013.01)

(58) Field of Classification Search

CPC ..... B65D 47/0885; B65D 2251/1016; B65D 2251/1025; B65D 2251/1058; B65D 43/22; A47G 19/2272

USPC ..... 220/254.8, 324, 833–835; 215/208, 216

See application file for complete search history.

(56) References Cited

U.S. PATENT DOCUMENTS

| | | | | |
|---|---|---|---|---|
| 8,651,305 | B1 * | 2/2014 | Lunn | B65D 51/002 215/228 |
| 2007/0228061 | A1 * | 10/2007 | Giraud | B65D 50/061 220/839 |
| 2013/0144219 | A1 * | 6/2013 | Evans | A61M 5/3202 604/192 |
| 2014/0034644 | A1 * | 2/2014 | Wahl | B65D 43/16 220/254.6 |

* cited by examiner

*Primary Examiner* — James N Smalley
(74) *Attorney, Agent, or Firm* — Pearne & Gordon LLP

(57) ABSTRACT

The utility model relates to a cover, and discloses a cup cover with quick locking function, and a cup, wherein the cup cover includes a cover body and a rotating member arranged on the cover body, the rotating member is provided with a clamping hook, and the rotating member can rotate relative to the cover body, so as to drive the clamping hook to reciprocate between a first position and a second position. A rotatable clamping buckle locking structure is used in the utility model to replace a screw thread locking structure in the related art, which can reduce the time for operating the cup cover, implements quick opening and closing of the cup cover, enables the drinking action of a user more smooth and nature, and helps to improve the user experience.

5 Claims, 7 Drawing Sheets

CUP COVER WITH QUICK LOCKING FUNCTION AND CUP

FIELD

The utility model relates to a cover matched with a container, and more particularly, to a cup cover of a cup, and the cup using the cup cover.

BACKGROUND

As a common water drinking equipment, a cup is one of indispensable appliances in people's lives, which not only can be directly used for daily drinking, but also can be served as a water storage apparatus that can facilitate drinking of people while outgoing. For the latter cup, a cup cover is an indispensable part. The cup cover in the related art is usually connected with the cup body through a thread connection manner. However, this manner can enable drinking only when the cup cover is completely unscrewed, which causes a long operating time and slow opening speed, and is not beneficial for users to use.

SUMMARY

In order to overcome the defects of the prior art, the utility model provides a cup cover with quick locking function, which is configured to solve the problems of slow opening speed of the cup cover and difficultly cleaned thread structure in the related art caused by fixing the cup cover using a screw thread manner.

To solve the technical problems, the utility model employs the technical solutions as follows:

A cup cover with quick locking function includes a cover body and a rotating member arranged on the cover body, wherein the rotating member is provided with a clamping hook, and the rotating member can rotate relative to the cover body, so as to drive the clamping hook to reciprocate between a first position and a second position.

As a further improvement manner of the foregoing solution, the top plate of the cover body is provided with a limiting slot, the limiting slot is arranged along the rotating route of the clamping hook, the clamping hook vertically protrudes out from the rotating member and stretches into the inner chamber of the cover body after traversing the limiting slot, and the rotating angle of the clamping hook is limited by the limiting slot.

As a further improvement manner of the foregoing solution, the rotating member is a cylindrical structure with an opening below, and is sleeved at the top of the cover body, and the clamping hook protrudes out from the inside surface of the top plate of the rotating member.

As a further improvement manner of the foregoing solution, one end of the limiting slot is provided with a bulge for vertically inserting or pulling out the clamping hook.

As a further improvement manner of the foregoing solution, the rotating member is provided with two symmetrical clamping hooks, and the cover body is correspondingly provided with two limiting slots.

A cup includes a cup body and further includes the above-mentioned cup cover, wherein the top of the cup body is provided with a bubbler, an edge is protruded out from the periphery of the bubbler, the cup cover is connected with the cup body through the cover body, and when the clamping hook is located at the first position, the clamping hook and the edge are mutually separated, and when the clamping hook moves to the second position, the clamping hook is buckled below the edge.

As a further improvement manner of the foregoing solution, the edge is distributed along a rectangular periphery.

As a further improvement manner of the foregoing solution, the inside surface of the top plate of the cover body is provided with a sealing gasket for blocking the bubbler.

As a further improvement manner of the foregoing solution, a horizontal connecting arm protrudes out from the side wall of the cover body, the tail end of the connecting arm is provided with a hinging seat, and the cup cover is hinged with the cup body through the hinging seat.

As a further improvement manner of the foregoing solution, the side wall of the cover body is provided with a locking bore, the cup body is provided with a locking plate, and the locking plate can move along the horizontal direction so as to be inserted into the locking bore.

The utility model has the advantageous effects that:

a rotatable clamping buckle locking structure is used to replace a screw thread locking structure in the related art, which can reduce the time for operating the cup cover, implement quick opening and closing of the cup cover, enable the drinking action of a user more smooth and nature, and help to improve the user experience; and a complicated thread structure is not involved between the cup cover and the cup body, so that the cleaning difficulty of the cup cover and the cup body can be effectively reduced.

BRIEF DESCRIPTION OF THE DRAWINGS

The utility model will be described with reference to the drawings and embodiments hereinafter.

DETAILED DESCRIPTION

Figure 1:
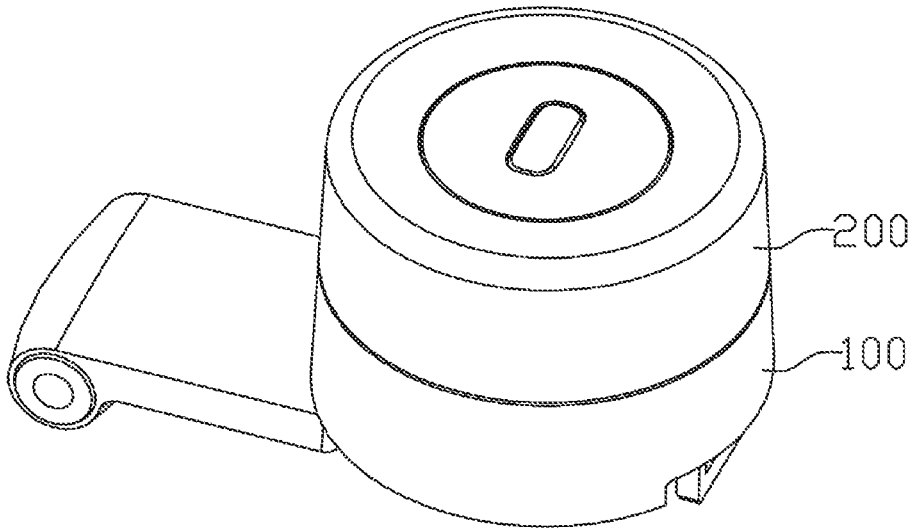
FIG. 1 is a stereoscopic schematic diagram showing one embodiment of a cup cover according to the utility model.

The conception and specific structure of the utility model and technical effects produced thereof will be clearly and completely described hereinafter with reference to the embodiments and drawings, so as to sufficiently understand the objects, solutions and effects of the utility model. It should be illustrated that the embodiments in the present application and the features in the embodiments can be mutually combined in case of no conflicting.

It should be illustrated that when a certain feature is called as "fixed", and "connected" to another feature, the feature can either be directly fixed and connected to another feature, or can be indirectly fixed and connected to another feature unless stated. Moreover, the descriptions like up, down, left and right used in the utility model are only direct to the mutual position relationship of each component of the utility model in the drawings.

In addition, the technical and scientific terms used herein are identical to the meanings usually understood by those skilled in the art unless otherwise defined. The terms used in the description herein are only used to describe specific embodiments, but are not intended to limit the present invention. The term "and/or" used herein includes any combination of one or more related items listed.

Figure 2:
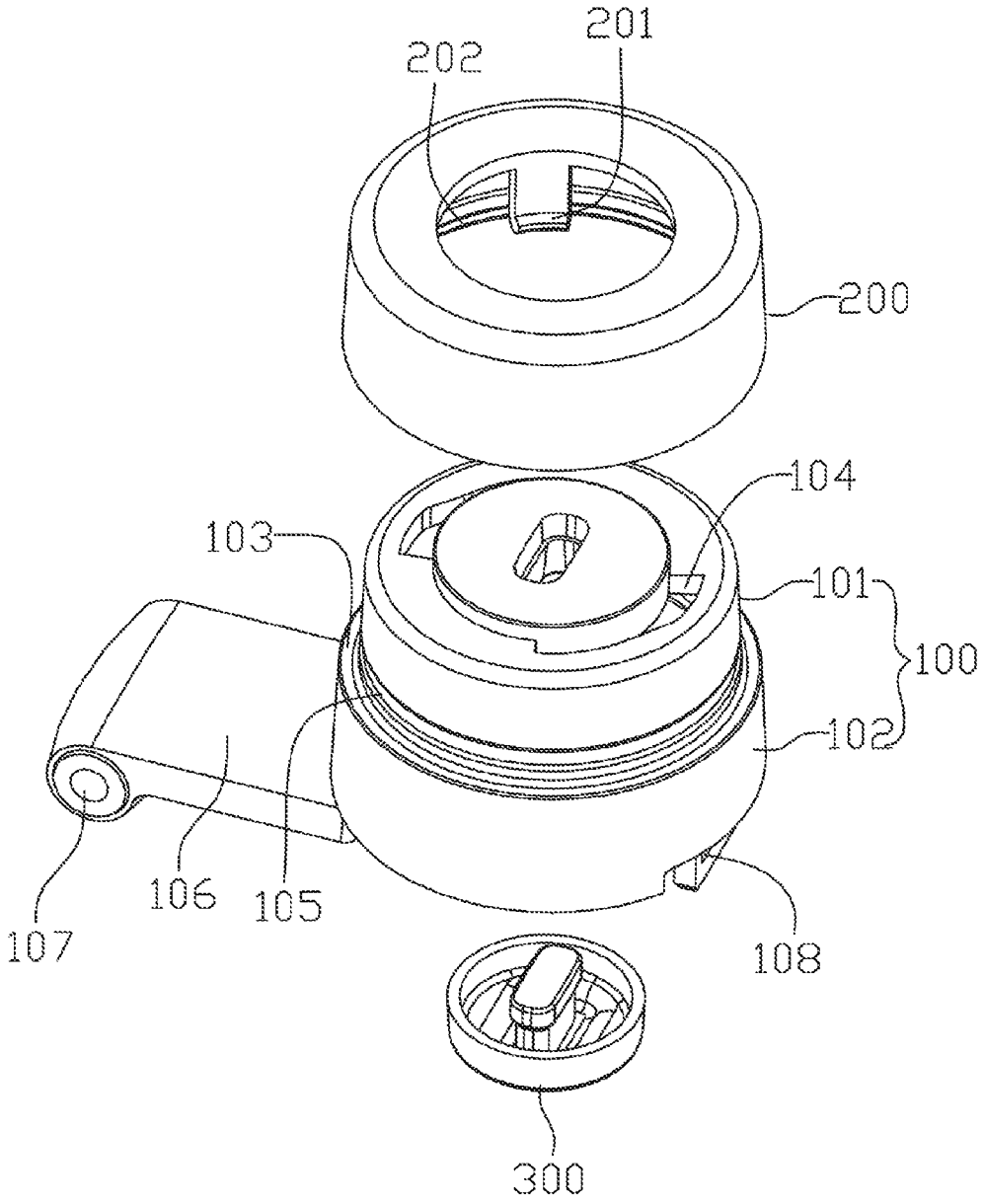
FIG. 2 is an exploded schematic diagram showing one embodiment of the cup cover according to the utility model.

FIG. 1 and FIG. 2 show a stereoscopic schematic diagram of one embodiment of a cup cover according to the utility model and an exploded schematic diagram thereof on the same direction, wherein the cup cover includes a cover body 100 and a rotating member 200 arranged on the cover body. In the embodiment, the bottom of the cover body 100 is provided with an opening, the rotating member 200 is arranged above the cover body 100. To be specific, a step surface 103 exists between the top part 101 and the bottom part 102 of the cover body 100, and the diameter of the top part 101 is less than that of the bottom part; moreover, the rotating member 200 is preferably a cylindrical structure with an opening below, and sleeved on the top part 101 of the cover body 100, thus forming an entirety seemingly.

The rotating member 200 may be of other shapes, such as a plate like structure or lumpy structure; and the rotating member 200 may also be connected with the cover body 100 using other manners.

The rotating member 200 is provided with a clamping hook 201. Preferably, the clamping hook 201 is arranged at the inner surface of the top plate of the rotating member, and protrudes out vertically towards the down side. Correspondingly, the top plate of the cover body 100 is provided with a structure for the clamping hook 201 to traverse. In the embodiment, the above-mentioned structure is a limiting slot 104, and the limiting slot 104 may allow the clamping hook 201 to traverse the top plate of the cover body 100 and stretch into the inner chamber of the cover body 100.

The rotating member 200 and the clamping hook 201 may integrally rotate relative to the cover body 100. Meanwhile, due to the limiting effect of the limiting slot 104 on the clamping hook 201, the clamping hook 201 can only move between one end (the first position) and the other end (second position) of the limiting slot 104.

In order to ensure that the rotating member 200 not only can rotate relative to the cover body 100 but also can be not separated from the cover body, the inside surface of the rotating member 200 is provided with a turn of bulge 202, the outside surface of the top part 101 of the cover body 100 is provided with a turn of recess 105; when the rotating member 200 is sleeved on the cover body 100, the bulge 202 is buckled in the recess 105.

A horizontal connecting arm 106 protrudes out from the side wall of the cover body 100, the tail end of the connecting arm 106 is provided with a hinging seat 107, and the cup cover 100 is provided with a locking bore 108 with respect to the other side of the connecting arm 106.

Furthermore, the inside of the cover body 100 is further provided with a sealing gasket 300 for sealing the bubbler.

Figure 3:
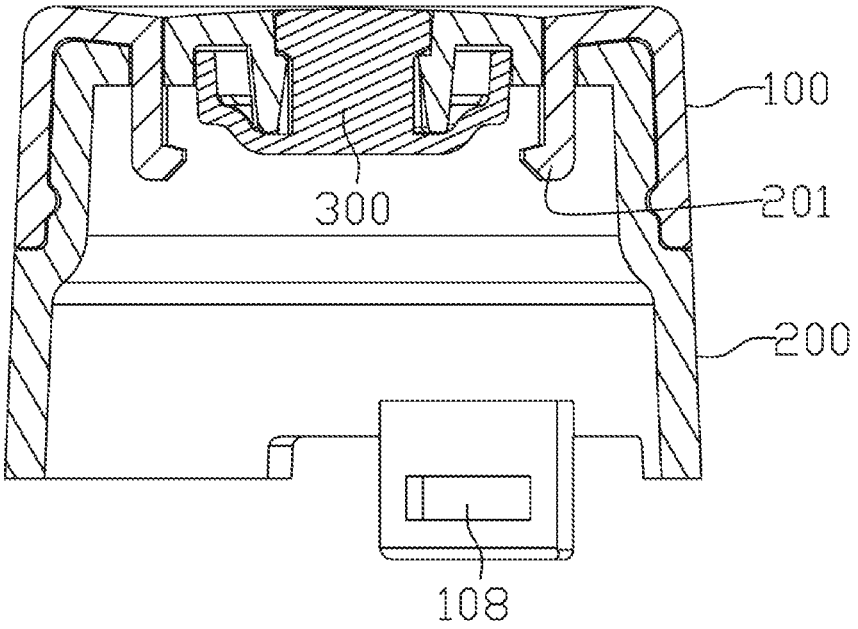
FIG. 3 is a cross-sectional view showing one embodiment of the cup cover according to the utility model.

FIG. 3 shows a cross-sectional view of the cup cover according to the utility model, wherein the cross section is a vertical plane that passes through the axle center of the cover body 100 and also passes through the center of the clamping hook 201. It can be known from the figure that the rotating member 200 is sleeved on the cover body 100, and the two are connected through the bulge and the recess. Two clamping hooks 201 are preferred, which are distributed symmetrically by taking the center of the rotating member 200 as the axis, and meanwhile, two limiting slots are also arranged on the cover body 100 correspondingly.

The sealing gasket 300 is then buckled on the inner surface of the top plate of the cover body 100 through a buckling position.

Figure 4:
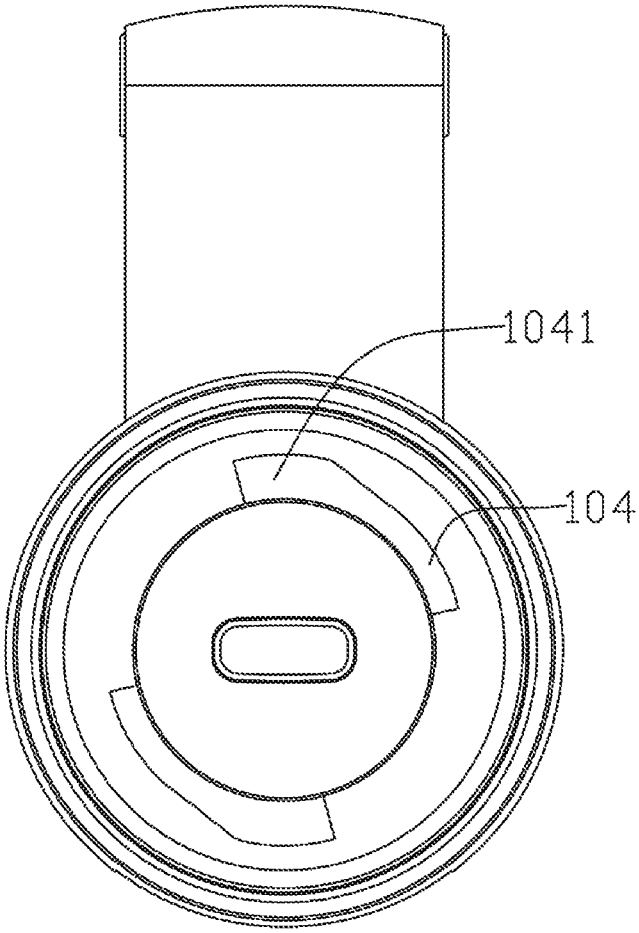
FIG. 4 is a top view of one embodiment of the cover body according to the utility model.

FIG. 4 shows a top view of one embodiment of the cover body 100 according to the utility model, wherein two limiting slots 104 are arranged along the motion route of the clamping hook 201, i.e., the limiting slots are distributed in a circular arc. One end of the limiting slot 104 is provided with a bulge 1041, and the bulge is configured to vertically insert or pull out the clamping hook 201.

Figure 5:
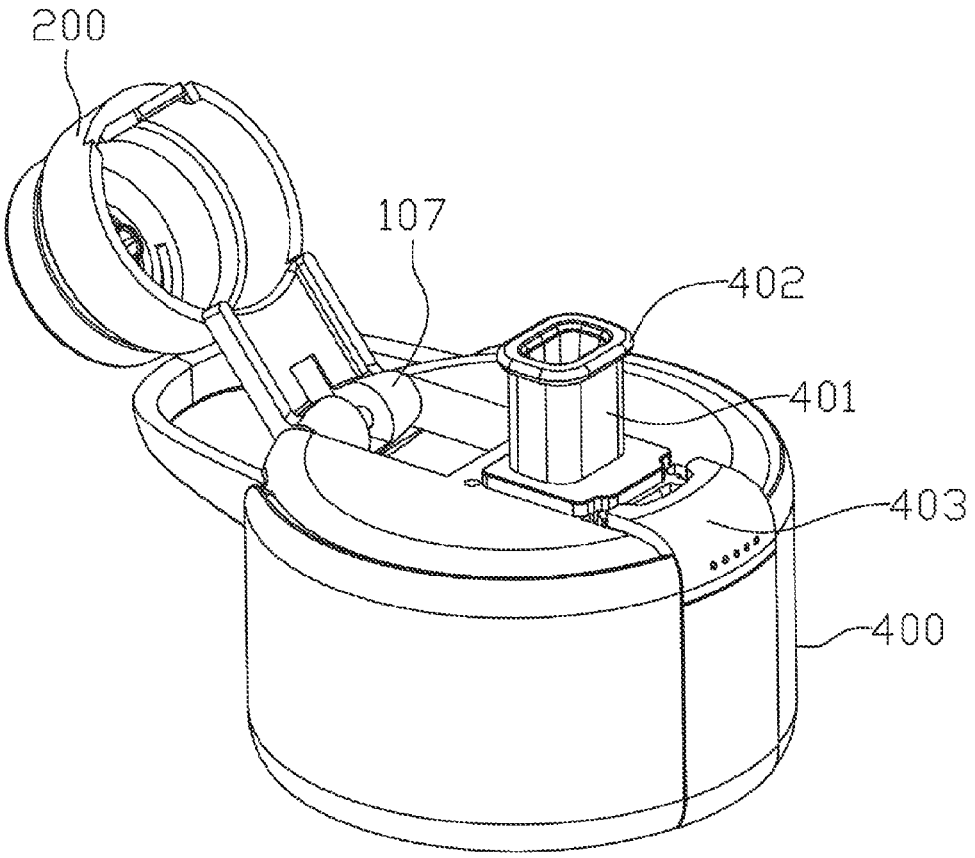
FIG. 5 is a stereoscopic schematic diagram showing one embodiment of a cup according to the utility model.

FIG. 5 shows a stereoscopic schematic diagram of one embodiment of a cup according to the utility model, wherein the cup includes a cup body 400 and the cup cover above. In the figure, the cup cover is under an open state and the rotating member is hidden, and only a part of the cup body 400 is shown. The top of the cup body 400 is provided with a bubbler 401, an edge 402 protrudes out from the periphery of the bubbler 401, and the cup cover is articulated on the cup body 400 through a hinging seat 107, so that the cup cover can rotate relative to the cup body 400 to cover or uncover the bubbler 401.

Figure 6:
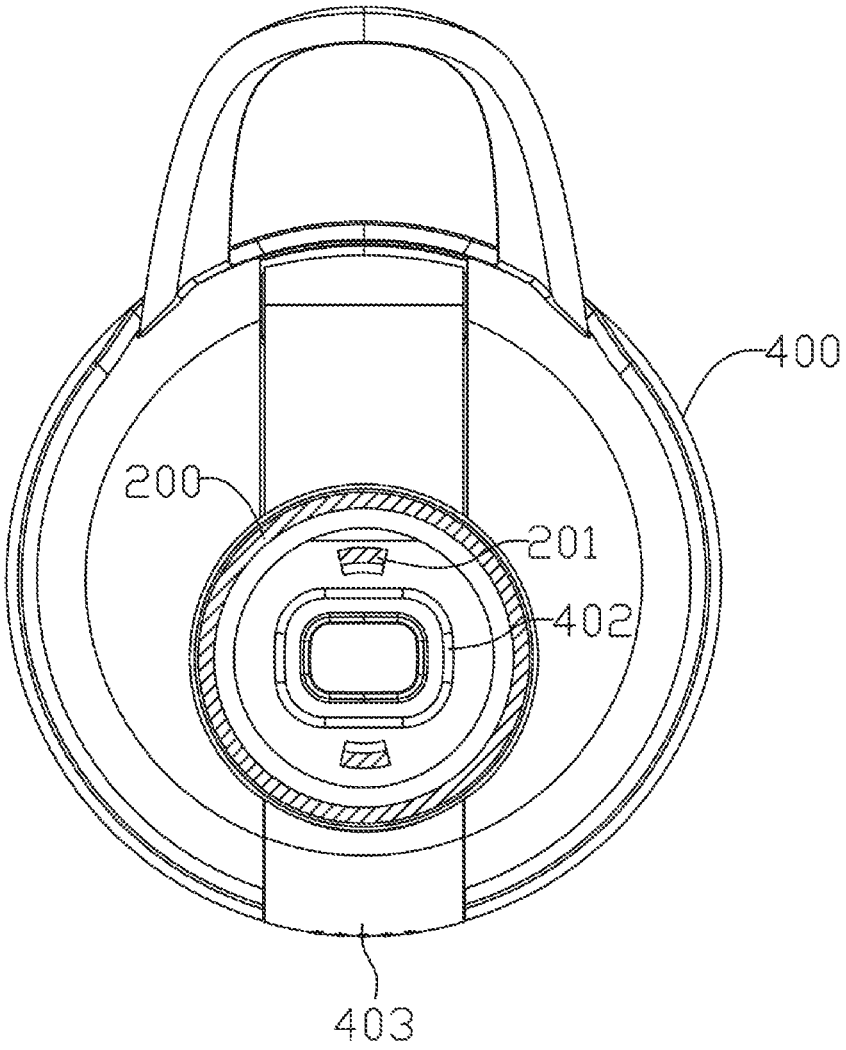
FIG. 6 is a cross-sectional view showing the cup of the utility model (the cup cover is unlocked)

FIG. 6 shows a cross-sectional view of the cup according to the utility model when the cup cover is unlocked, wherein the cross section is a horizontal plane parallel to the top surface of the cup body 400, and meanwhile, the cross section passes through the top side of the bubbler 401 and shows the clamping hook 201 in a cross-sectional manner, wherein the sealing gasket is hidden in the figure. It can be known from the figure that when the cup cover is just covered on the cup body, the clamping hook 201 is located at one end (i.e., the first position) of the limiting slot; at this moment, the clamping hook 201 is located outside the edge 402, i.e., not contacted with the edge 402, so that the clamping hook 201 may stretch into the lower side of the edge 402.

Figure 7:
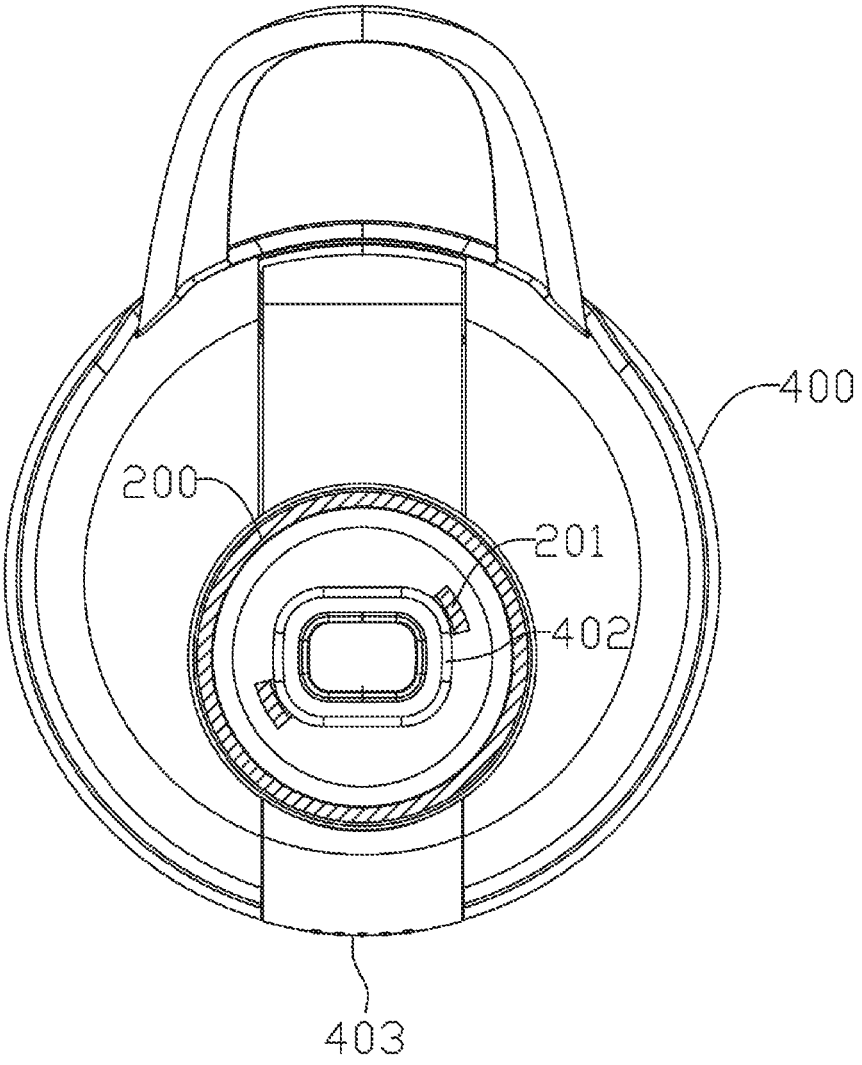
FIG. 7 is a cross-sectional view showing the cup of the utility model (the cup cover is locked).

FIG. 7 shows a cross-sectional view of the cup according to the utility model when the cup cover is locked, wherein the position of the cross section is unchanged. It can be known from the figure that the clamping hook 201 moves to the other end (i.e., the second position) of the limiting slot through rotating; at this moment, the clamping hook 201 is located below the edge 402 yet, so that the locking between the cup cover and the cup body is implemented; meanwhile, the sealing gasket which is not shown is tightly pressed on the bubbler 401 to seal the cup.

In order to realize the foregoing objects, the edge 402 in the embodiment is distributed along a rectangle. That is to say, the cross section of the bubbler is a rectangle. In this manner, when the clamping hook 201 is located at the first position, the clamping hook is just located at the two ends of the long side of the rectangle. Because the width of the rectangle is less than the diameter of the motion track of the clamping hook 201, the clamping hook 201 and the edge 402 are mutually separated; however, when the clamping hook 201 is located at the second position, the clamping hook is just distributed along the diagonal line of the rectangle; at this moment, the distance between the edges 402 is greater than the diameter of the minimum motion track of the clamping hook 201 yet; therefore, the clamping hook 201 can be limited.

Of course, the distribution of the edge 402 is not limited to the above embodiment; for example, the edge 402 may be only distributed at the two ends of the long side of the rectangle; and the edge 402 may even be replaced by an independent buckling position.

In order to lock the cup cover more preferably, referring to FIG. 5, the position of the cup body 400 corresponding to the locking bore is provided with a locking plate 403; when the cup cover covers the bubbler 401, the locking bore is just aligned with the locking plate 403, and the locking plate 403 can be inserted into the locking bore through moving along the horizontal direction.

The above is specific explanations to the preferred embodiments of the utility model, but the utility model is not limited to the embodiments. Those skilled in the art may make various equivalent modifications or substitutions without departing from the spirit of the utility model, and these equivalent modifications or substitutions shall all fall within the scope defined by the claims of the present application.

What is claimed is:

1. A cup cover with quick locking function, comprising a cover body and a rotating member arranged on the cover body, wherein the rotating member is provided with a clamping hook, and the rotating member can rotate relative to the cover body, so as to drive the clamping hook to reciprocate between a first position and a second position, wherein the top plate of the cover body is provided with a limiting slot, the limiting slot is arranged along the rotating route of the clamping hook, the clamping hook vertically protrudes out from the rotating member and stretches into the inner chamber of the cover body after traversing the limiting slot, and the rotating angle of the clamping hook is limited by the limiting slot.

2. The cup cover with quick locking function according to claim 1, wherein the rotating member is a cylindrical structure with an opening below, and is sleeved at the top of the cover body, and the clamping hook protrudes out from the inside surface of the top plate of the rotating member.

3. The cup cover with quick locking function according to claim 1, wherein one end of the limiting slot is provided with a bulge for vertically inserting or pulling out the clamping hook.

4. The cup cover with quick locking function according to claim 3, wherein the rotating member is provided with two symmetrical clamping hooks, and the cover body is correspondingly provided with two limiting slots.

5. A cup comprising a cup body, wherein the cup further comprises the cup cover according to claim 4, the top of the cup body is provided with a bubbler, an edge is protruded out from the periphery of the bubbler, the cup cover is connected with the cup body through the cover body, and when the clamping hook is located at the first position, the clamping hook and the edge are mutually separated, and when the clamping hook moves to the second position, the clamping hook is buckled below the edge, wherein the inside surface of the top plate of the cover body is provided with a sealing gasket for blocking the bubbler.

* * * * *